US006536766B1

(12) United States Patent
Deitch et al.

(10) Patent No.: US 6,536,766 B1
(45) Date of Patent: Mar. 25, 2003

(54) MULTI-FUNCTIONAL GAME BOARD WITH ROTATING MECHANISM

(76) Inventors: Donald T. Deitch, 72 Amber Dr., San Francisco, CA (US) 94131; Betty Lee Deitch, 72 Amber Dr., San Francisco, CA (US) 94131

( * ) Notice: Subject to any disclaimer, the term of this patent is extended or adjusted under 35 U.S.C. 154(b) by 0 days.

(21) Appl. No.: 09/872,819

(22) Filed: May 31, 2001

Related U.S. Application Data

(60) Provisional application No. 60/208,049, filed on May 31, 2000, provisional application No. 60/208,033, filed on May 31, 2000, and provisional application No. 60/260,589, filed on Jan. 8, 2000.

(51) Int. Cl.[7] ..... A63F 3/00

(52) U.S. Cl. ..... 273/287; 273/280; 273/142 R

(58) Field of Search ..... 273/287, 280, 273/283, 285, 142 R, 142 H, 142 HA, 142 A, 142 J

(56) References Cited

U.S. PATENT DOCUMENTS

| | | | | | |
|---|---|---|---|---|---|
| 174,168 | A | * | 2/1876 | Tros | |
| 1,833,793 | A | * | 2/1931 | Pfleger | |
| 2,215,696 | A | * | 9/1940 | Graves | 273/142 HA |
| 3,030,112 | A | * | 4/1962 | Scharp | 273/240 |
| 3,397,890 | A | * | 8/1968 | Newton | 273/142 R |
| 3,606,334 | A | | 9/1971 | Pippin | |
| 3,809,407 | A | | 5/1974 | Quigley | |
| 4,099,723 | A | | 7/1978 | Robinson | |
| 4,431,195 | A | | 2/1984 | Brand | |
| 4,484,749 | A | | 11/1984 | Charney | |
| 4,648,601 | A | | 3/1987 | Carmichael | |
| 4,696,476 | A | | 9/1987 | Epplet | |
| 4,778,186 | A | * | 10/1988 | Dudley | 273/142 R |
| 4,934,707 | A | | 6/1990 | Koster | |
| 4,948,145 | A | * | 8/1990 | Breslow | 273/142 R |
| 5,013,048 | A | | 5/1991 | Turner | |
| 5,033,751 | A | | 7/1991 | Ching | |
| 5,388,836 | A | | 2/1995 | Foti | |
| 5,409,234 | A | | 4/1995 | Bechier | |
| 5,810,359 | A | | 9/1998 | Wilkins | |
| 5,829,747 | A | | 11/1998 | Nebel | |
| 6,189,886 | B1 | | 2/2001 | Moran | |
| 6,217,022 | B1 | * | 4/2001 | Astaneha | 273/138.1 |

* cited by examiner

*Primary Examiner*—Benjamin H. Layno
*Assistant Examiner*—V K Mendiratta
(74) *Attorney, Agent, or Firm*—John Heyman

(57) ABSTRACT

A novel game board comprises a base board (100) with rotating tiers (105, 405, 410, and 415) which rotate on a shaft (430) and bearings (402, 404, and 407) or a lazy susan (115), a pointer 120 or a rotating pointer knob (425) which points at numbers (305) and game fields (310) on a tier (300). Progress through the game is indicated by individual players' tokens (135). Game cards and play money (140, 320, 325, 330, and 335) are also provided. Multiple results can arise from the same players' moves. Hidden game fields (700) under the edges of square or rectangular tiers (405, 410, and 415) provide added excitement. Instructions in the game fields (300, 406, etc.) can apply to a single player or to all players simultaneously, resulting in advantages or disadvantages for one or all. No dice are used to play, only a rotating pointer knob (425) or a rotating tier 105 with a stationary pointer (120) are required to urge progress through the game. The same mechanical arrangement is applicable in a variety of games, resulting in an economy of scale for manufacturers.

14 Claims, 6 Drawing Sheets

MULTI-FUNCTIONAL GAME BOARD WITH ROTATING MECHANISM

BACKGROUND—CROSS-REFERENCE TO RELATED APPLICATIONS

This application claims the benefit of the following provisional patent applications: Serial No. 60/208,049 filed May 31, 2000 Serial No. 60/208,033 filed May 31, 2000 and Serial No. 60/260,589 filed Jan. 8, 2001.

FEDERALLY SPONSORED RESEARCH—None

SEQUENCE LISTING OR PROGRAM—None

BACKGROUND—FIELD OF INVENTION

This invention relates to board games, and in particular to a board game apparatus that produces random results and is the base for various derivative games.

BACKGROUND—PRIOR-ART

Board games in which the object is either to acquire the most wealth, bankrupting opposing players, or win the game by completing some object or goal first are well-known and replete with many versions. See, for example, the real estate trading game of Lizzie J. Magie in U.S. Pat. No. 748,626 (1904). Those games generally provide static playing fields and seldom provide play that is challenging or stimulating to the players.

In U.S. Pat. No. 3,804,416 (1974) Jones et al. disclose a game having two playing boards, one mounted on top of the other. The object of this game is to move pegs from one board to another. The structure of this game is awkward in design and contributes unnecessary complications to a simple game.

In U.S. Pat. No. 3,606,334 (1971) Pippin discloses a board game that includes rotatable discs. The board in Pippin's game is cluttered and difficult to understand.

In U.S. Pat. No. 4,099,723 (1977) Robinson describes a three-dimensional, multi-level inverse chess board that is over-complicated.

In U.S. Pat. No. 5,409,234 (1993) Bechier discloses a four-dimensional game and a three-dimensional apparatus used for playing the game that uses tokens. The game is difficult to play because it is complicated with numerous game pieces and structural elements.

U.S. Pat. No. 5,033,751 (1990) to Ching describes a multi-tier checkered game board for checkers in a cumbersome and awkward design and is a complicated way to play checkers.

U.S. Pat. No. 4,484,749 (1983) to Charney discloses a game board that comes in several different pieces. Those pieces can be assembled in a variety of different combinations. The game requires substantial skill to play.

U.S. Pat. No. 4,585,233 to Wilson (1986) discloses an add-on board for a real estate trading game. It further complicates the game without improving it.

U.S. Pat. No. 4,696,476 to Eplett (1986) describes a multi-stepped game board in a checkerboard design and adds nothing to the game but complication.

While some games provide variable moves, they are often too complex to stimulate interest in younger participants. Other games are too simple to challenge the more intellectual players. All prior-art games provide only a single result for each move. The games are also require too long a period of playing time to determine the winner, thereby causing participants to lose interest. Many games are found to have too many game board parts and accessories and can become lost between the playing of games.

BACKGROUND—OBJECTS AND ADVANTAGES

Accordingly several objects and advantages of the present invention are to provide an improved game board, to provide a game with simple, variable moves, with a play period of reasonable duration, and with a limited number of game board parts. Further objects and advantages are to provide a multi-functional game board with a rotating mechanism that provides a base for any number of games, ranging form simple to complex, a game with a methodology of play which has the advantage of providing multiple random results, which is challenging yet simple to play, which has hidden instructions beneath swiveling tiers that produce multiple and unexpected results for the game players, which uses no dice, and which produces unexpected changes in fortune that affect not only one but all of the players simultaneously. Further objects and advantages will become apparent from the ensuing description and accompanying drawings.

SUMMARY

In accordance with the present invention, a board game has one or more swiveling tiers. These tiers provide a basis for a set of games which utilize similar constructions, mechanisms, and play, providing numerous games of varying complexity which produce random and unexpected results. Since each move by another player can affect other players positively or adversely, every play by opposing players creates strong interest and excitement in the game play for all players. Additionally, since no dice are used in the games, interest in the activity and moves by other players is substantially increased by all players. This is due to the randomness of multiple results achieved by this device without the use of complicated mathematical calculations. The multiple results also offer challenging, easy to understand play.

The game tiers can be adapted to other media beside board games, for example, a television game show format, computer games, hand-held computerized games, online interactive games, and slot machine apparatuses, among others.

DRAWINGS—FIGURES

Figure 1:
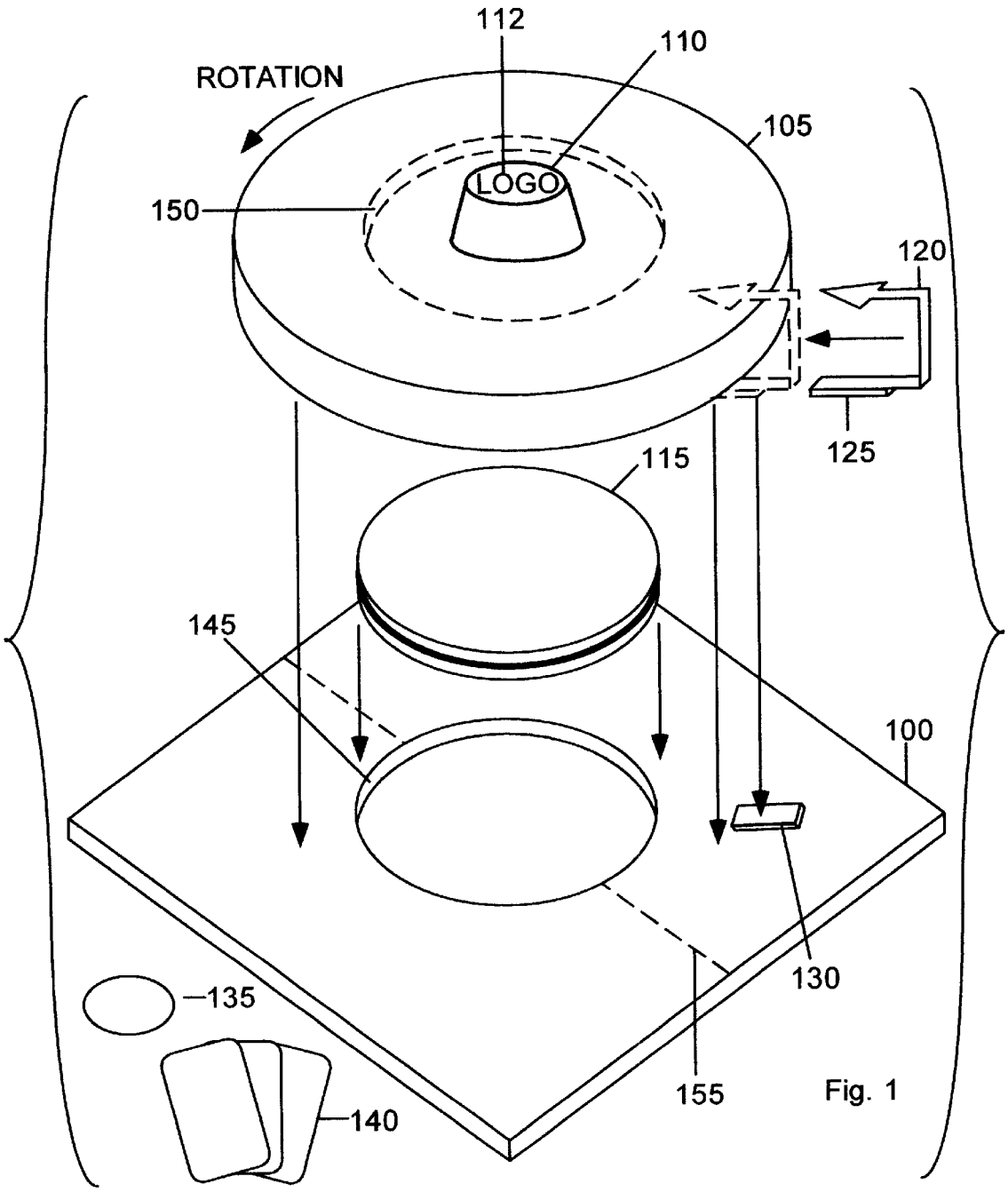
FIG. 1 shows an exploded, perspective view of a single-tier game in accordance with the invention.

| DRAWINGS-Reference Numerals |
|---|
| 100 Game board |
| 105 Tier |
| 110 Knob |
| 112 Logo |
| 115 Swiveling mechanism |
| 120 Pointer |
| 125 Fastener |
| 130 Mating fastener |
| 135 Token |
| 140 Game cards |
| 145 Hole or recess |
| 150 Recess |
| 155 Fold line |
| 300 Game field |
| 301 Outer circle |
| 302 Inner circle |
| 304 Game field destination "Africa" |
| 305 Number |
| 306 Destination name |
| 307 Price |
| 310 Additional game field |
| 314 Game field destination "Mexico" |
| 319 Game field "Travel Ups & Downs" |
| 320 Destination card |
| 325 Travel Ups & Downs card |
| 330 Voucher |
| 335 Play money |
| 336 Travel bonus corner |
| 340 Starting point |
| 400 Board of multi-tiered game |
| 401 Hole |
| 402 Spacer |
| 404 Spacer |
| 405 First tier |
| 406 Game field on board |
| 407 Spacer |
| 410 Second tier |
| 411 Game field on first tier |
| 415 Third tier |
| 416 Game field on second tier |
| 420 Numeral |
| 421 Game field on third tier |
| 425 Pointer knob |
| 430 Shaft |
| 435 Token |
| 436 Base camp #1 |
| 437 Base camp #2 |
| 438 Base camp #3 |
| 439 Base camp #4 |
| 440 Game field "Jump Up" |
| 441 Game field "Jump Up" |
| 442 Game field "Jump Up" |
| 443 Game field "Short Cut Down" |
| 444 Game field "Short Cut Down" |
| 445 Game field "Short Cut Down" |
| 446 Game field on first tier |
| 447 Game field on first tier |
| 448 Game field on board tier |
| 449 Game field on board tier |
| 460 Instruction Card |
| 600 Ring |
| 610 Hole |
| 700 Hidden game field on board |
| 701 Hidden game field on second tier |
| 702 Hidden game field on first tier |
| 703 Hidden game field on board tier |
| 704 Hidden game field on first tier |
| 705 Hidden game field on second tier |
| 706 Hidden game field on board |
| 707 Hidden game field on first tier |
| 708 Hidden game field on second tier |
| 709 Hidden game field on board |
| 710 Hidden game field on first tier |
| 711 Hidden game field on second tier |
| 800 Disk |
| 801 Disk |
| 802 Disk |

-continued

| DRAWINGS-Reference Numerals |
|---|
| 803 Disk |
| 810 Cog |
| 820 Slot |
| 822 Shaft |
| 900 Instruction |
| 901 Instruction |
| 902 Instruction |
| 910 Instruction |

DETAILED DESCRIPTION—PREFERRED EMBODIMENT—FIGS. 1 THROUGH 3

FIG. 1 is an exploded perspective view of a tiered game board assembly. The assembly comprises a game board 100, a swiveling tier, disc, platter, or turntable 105 with an attached knob 110, a swiveling mechanism 115, a pointer 120 with an attached fastener 125, and a mating fastener 130 affixed to board 100. A logo 112 is optionally printed on the top of knob 110. Board 100 is preferably 50 cm square and 0.5 cm thick, although it can be any size or shape. Board 100 can be folded along line 155 for storage. Tier 105 is typically 30 cm in diameter and 2 cm high.

The tops of board 100 and tier 105 are imprinted with the characteristics of a particular game (example shown below in FIG. 3). One or more moving game pieces or tokens 135, game cards 140, and play money (not shown) are used. Game cards 140 are printed with instructions (not shown), values appropriate to the game, and the like. (Game cards are discussed further in connection with FIG. 3.)

Swiveling mechanism 115 has upper and lower discs which are rotatably connected, preferably with a ball bearing mechanism so that it resembles and functions like a lazy susan. When the game is assembled, the bottom portion of swiveling mechanism 115 slidably force fits into hole or recess 145 in board 100, while the top portion force fits into a recess 150 in tier 105. Hole 145 and recess 150 are about 30 cm in diameter. Hole 145 preferably extends through board 100, or it can be a recess about 0.25 cm deep. Recess 150 in tier 105 is about 0.5 cm deep. Swiveling mechanism 115 is of sufficient height, about 1.5 cm, to hold tier 105 about 0.5 cm above board 100, permitting tier 105 to rotate freely when turned by knob 110. Tier 105 is sufficiently heavy so that it will continue to spin like a roulette wheel after it is started. Fastener 125 on pointer 120 attaches to mating fastener 130 on board 100. Fasteners 125 and 130 are preferably hook-and-loop fasteners, although a slot and snap-in or force-fit plug, or any other temporary fastener, such as double-stick tape or velcro will suffice.

Figure 2:
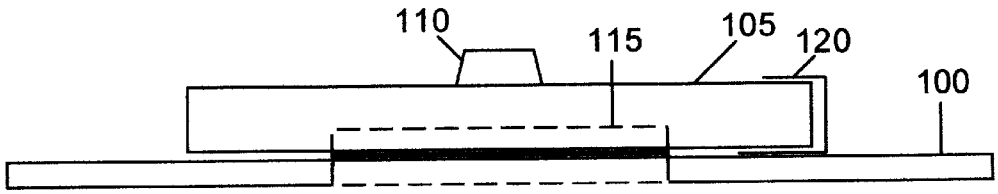
FIG. 2 is a side view of the board in FIG. 1.

FIG. 2 shows a side view of the game board components in place, ready to use.

Figure 3:
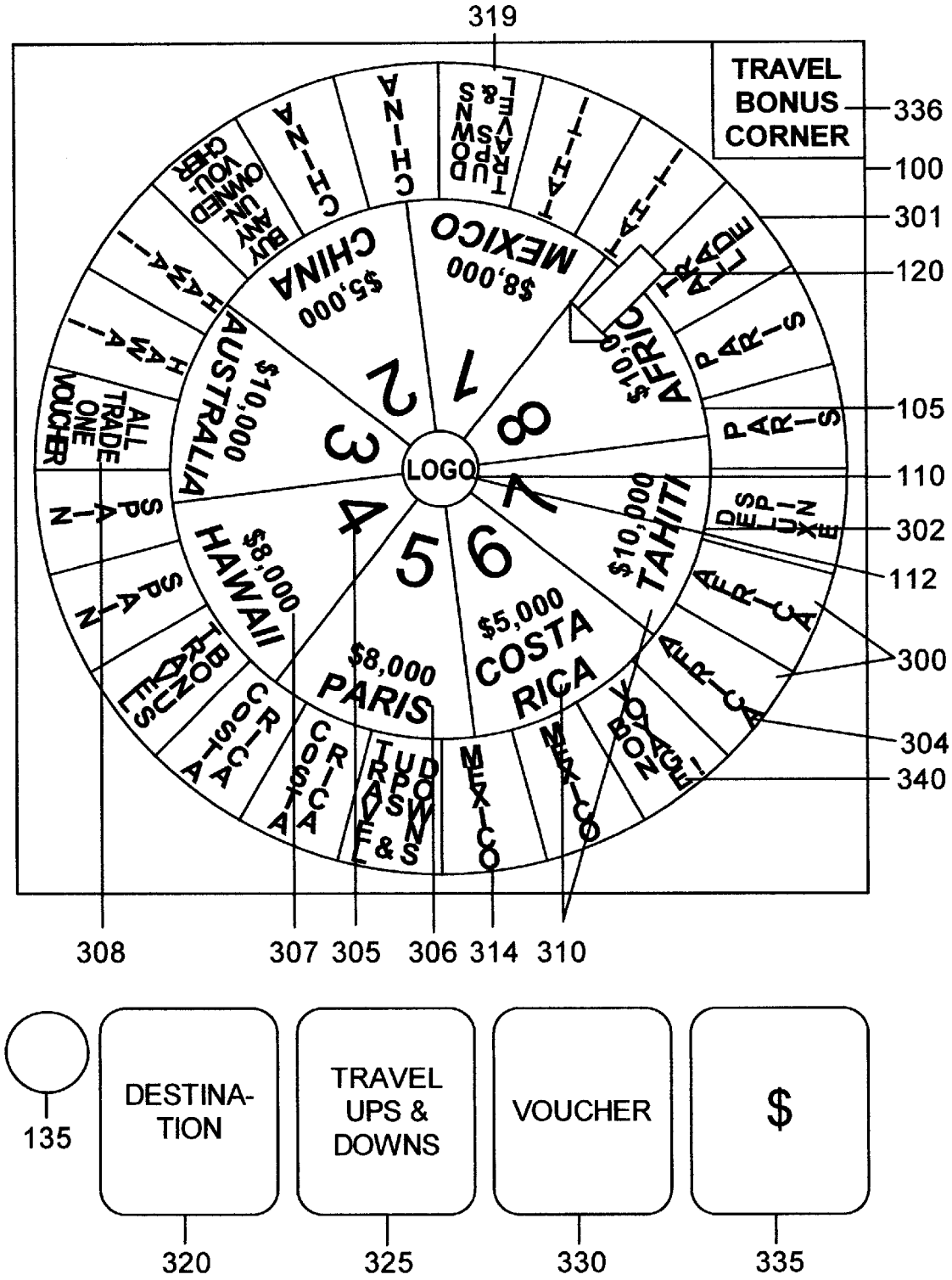
FIG. 3 is a top view of the single-tier game of FIG. 1, showing game fields.

FIG. 3 shows a plan view of the game of FIGS. 1 and 2.

The Board: Board 100 (FIG. 3) is imprinted with an outer circle 301 of stationary game fields or sectors 300. Fields 300 contain names of individual goals, here destinations, such as two activities in destination Africa, in field 304, and eight instructions, such as "All Trade One Voucher" in field 308. Preferably as shown, fields 300 have Africa, Deluxe Spin, Paris, All Trade, Tahiti, Travel Ups & Downs, China, Buy Any Unowned Voucher, Hawaii All Trade One Voucher, Australia, Travel Bonus, Costa Rica, Mexico, and Bon Voyage!

The Tier: The values of the completed trips are shown on inner circle 302. Additional game fields or sectors 310 are located around an inner circle 302 on tier 105. Fields 310 each include a number 305, a destination resort 306, and a currency amount 307. This represents the completed trip price that a player will receive when that player obtains all three vouchers to a destination. Fields 310 are selected by pointer 120 when tier 105 stops after a spin. Preferably, as shown, fields 310 are labeled as follows, numeral 1: $8,000, Mexico; 2: $5,000, China; 3: $10,000 Australia; 4: $8,000, Hawaii; 5: $8,000, Paris; 6: $5,000 Costa Rica; 7: $10,000, Tahiti; and 8: $10,000, Africa. Any countries' names can be entered in game fields 300 and 310. The completed total trip price should not exceed the maximum price paid for each voucher.

The Destination Cards: Destination cards 320, preferably 24 in number, 3 each for various trip destinations Africa, China, Tahiti, Paris, Mexico, Costa Rica, Australia, and Hawaii. These destinations can be any other destinations chosen for this game.

The game includes one token 135 for each player; each token has a different color or symbol for identification with a particular player. Preferably six tokens are provided. Game cards 140 (FIG. 1) comprise four types of cards: 24 Destination cards 320, twenty-four voucher cards 330 associated with various destinations 304, twenty-four "Travel Ups and Downs" cards 325 providing good and bad opportunities and events, and play money 335, preferably in quantities and denominations of two $5,000 bills, five $1,000 bills, five $500 bills, and five $100 bills, for a total of $18,000 for each player. Enough sets of the $18,000 total per player are provided for six players, plus additional play money kept by the Travel Agent for game play.

In the illustrated game "Vacation Spin", game fields 300 are travel destinations, such as a country name, and various game actions, such as "Deluxe Spin". Game fields 310 on tier 105 also represent travel destinations, such as country names. One game field 310 representing each destination is located on tier 105. One country name 306 on tier 105 is repeated in two, adjacent game fields 300 along outer circle 301 on board 100.

There is a unique voucher card 330 for each of the sixteen destination game fields 300, Africa, China, Tahiti, Paris, Mexico, Costa Rica, Australia, and Hawaii, on board 100. These represent two activities for each destination. There is one voucher card 330 for each of the eight destination game fields 310, Africa, China, Tahiti, Paris, Mexico, Costa Rica, Australia, and Hawaii, on tier 105. These represent the deluxe resorts at each destination. Each of the three voucher cards 330 for a destination 306 has a different price. For destination Africa 306, the resort is Game reserve (not shown) on tier 105, the two activities 300 are Climbing Mt. Kilimanjaro and Photo safari (not shown). The Game reserve voucher 330 shows a multiple of 400 times spin, Climbing Mt. Kilimanjaro is 600 times spin, and Photo safari is 200 time spin. Multiple results in prices can result, depending on what number a player spins to buy that voucher. However, the total price 307 paid for the three vouchers does not exceed the maximum spin of each of the vouchers. When a player has gathered three vouchers 330 to one destination, the player receives a destination card 320.

Operation—Preferred Embodiment—"Vacation Spin" Game—FIG. 3

Play: At the start of the game, one player is designated the "Travel Agent". The Travel Agent gives each player a number of pieces of play money 335 totaling, for example, $18,000 to use in playing the game. All players place their respective game tokens 135 on the game starting block 340, titled "Bon Voyage!" on board 100.

Players take turns spinning tier 105 by applying a momentary torque or twist to knob 110. When tier 105 stops spinning, pointer 120 points to a game field 310 of tier 105. (If pointer 120 points to a line separating two game fields 310, the player spins again.) A player then moves their token 135 counterclockwise along fields 300 a number of fields determined by the number 305 in the field indicated by pointer 120 after a spin. This is referred to as the "spin number" or simply the "spin". Motion occurs in a clockwise or counterclockwise direction, depending on the game instructions, discussed in more detail below.

Object: The object of the game is for two to six players to complete the most vacation destinations by acquiring three voucher cards and have a destination card for each completed destination, and to have the most money remaining at the end of the game.

Obtaining vouchers for game fields 310 on tier 105: One game field 310 representing each destination is located on tier 105. Two additional game fields 300 representing each destination are located on board 100. A destination is "completed" or visited when the position of rotatable tier 105 is such that a destination name 306 on tier 105 spans or overlaps two fields 300 with the same destination name on board 100. Upon completion of a destination, the player may purchase a Voucher card 330 for that destination game field 310. As mentioned above, there is a unique voucher card 330 for each of the sixteen destination game fields 300, Africa, China, Tahiti, Paris, Mexico, Costa Rica, Australia, and Hawaii, on board 100, and one voucher card 330 for each of the eight destination game fields 310, Africa, China, Tahiti, Paris, Mexico, Costa Rica, Australia, and Hawaii, on tier 105. One voucher 330 is for a resort 310 in tier 105, and two vouchers for activities 300 are for the same destination. Each of the three voucher cards 330 for a destination 306 has a different price, as described, which is determined by the spin times the multiple on Voucher 330.

Obtaining vouchers for game fields 300 on board 100: When a player's token 135 stops on a destination game field 300, the player may purchase a Voucher 330 for that destination at the price determined by the spinning of tier 105. For example, at the Mexico block 314, the voucher 330 for field 314 states (not shown) that a player will pay $100 times the spin to purchase the voucher 330 for that location. In another example, if the player spins 8 (i.e., the tier spins so that the sector labeled "8" stops under the pointer), the player would then pay 8×$100=$800.00 to buy the voucher 330 associated with field 314 for Mexico. This pricing method allows for variables in vacation, such as the type of accommodation, length of stay, and the like.

When a player has two vouchers 330 associated with game fields 300, that player tries to see if he can land on the third voucher 330 associated with game field 314 for the same destination. If the player achieves that, the player may purchase the voucher on which is stated the multiple, times the spin to purchase voucher 330 for that location. If the player does not get the third matching voucher 330, then the player moves the spaces according to numeral 305.

When a player completes the set of three vouchers 330, the player returns it to the Travel Agent and receives play money 335 for the amount indicated above destination 307. This frees up the vouchers 330 for other players to purchase. The player also receives a destination card 320, which is counted for $3,000 at the game's end. These destination cards 320 remind the player of the trips the player has completed. They can complete more than one trip to the same destination. Also this acts as a frequent traveler bonus, regardless of the cost of the trips completed to different destinations.

When the player purchases three vouchers 330 to a destination 306, he or she receives a card 320 indicating ownership of that destination. The Destination Card 320 for Mexico, is printed with "Mexico" on the front side. On the back side are various facts about Mexico, such as the language, number of square miles, climate, population, type of government, location, and the like.

All players must draw a Travel Ups & Downs card 325 whenever they land on "Travel Ups & Downs" block 319, or when they pass the "Bon Voyage" block 340 in outer circle 301. Travel Ups & Downs cards contain penalty or advantage instructions such as, "Camel ate my passport, pay $500" or "Antique Bargain fetches $5,000. Collect" and the like.

In the event that a player has the opportunity to purchase a destination and decides not to acquire it, the site is then open for auction among the other players. The minimum bid for a destination is $1 times the multiple, as stated on the voucher. For example, if the voucher states that the multiple is 600, then the lowest bid would be $1×600=$600. Bidding will continue until a higher bid is made, or two minutes has elapsed, whichever is longer. If there is no bid, then the player must take the next Travel Up or Down card 325 in the stack and follow the instructions thereon.

The player with the most completed destinations with the highest value and the most cash wins at the end of a set time limit of the game, usually between 60 and 90 minutes. Incomplete trips do not count toward the total. The game also ends when any player becomes bankrupt, and the player with the highest total at that time wins.

Additional features: Varying conditions bring about different prices of vacations, and each player randomly pays different prices for the same vacation because of spinning tier 105. No dice are required, and in fact dice do not provide the additional variable of third voucher 310 on tier 105. A particular game field 308 contains the instruction "All Trade One Space". When a player lands on this space all players are affected as follows: All players must trade one voucher to the left, regardless of value. A player may not trade the voucher he or she has just received, which can positively or negatively affect a player's position.

For example, a player may gain a matching voucher 330 or be required to break up a pair. If the player does not have a voucher to trade, she or he must pay a $1,000 or other penalty in play money 335 to the player who was to receive a voucher.

A player landing on travel bonus corner 336 picks up penalties accumulated there from the Travel Downs cards 325 instructions. The Travel Bonus corner represents discounts or bonanzas in Travel to the player who collects it. The Travel Agent replenishes the $1,000 after it is collected.

When a player lands on another player's destination space in the additional game field 310, they can challenge the owner to buy their voucher 330 associated with that space. The challenging player does this by spinning the tier. If a higher numeral 305 than the owner spins comes up, the challenging player is successful. He or she then pays the owner the multiple on the Voucher 330, times the number of the spin. For example, 300 times 8 (number of spin)=$2,400 to purchase the voucher 330. If the challenging player spins a lower numeral 305 than the owner, then he pays $1,000 penalty to the Travel Bonus corner. A challenging player would want to do this to complete getting all three of the Vouchers 330 to complete a trip to a certain destination.

When a player lands on a game field 310, where they own that voucher 330, they will be quizzed by the Travel Agent on facts about the destination. These facts are contained at the back of each voucher 330. If the player answers correctly, they receive $1,000 from the Travel Agent. If they answer incorrectly, they have to pay a $1,000 penalty to the Travel Bonus Corner. This gives incentives to players to learn about the destinations on vouchers 330 that they have acquired.

A player can also trade vouchers 330 with other players, before each player's turn, within a two minute time limit, kept by the Travel Agent. This provides an opportunity to use skill and strategy to complete the set of three vouchers 330 needed to purchase a certain destination.

Description—Alternative Embodiment—FIGS. 4 through 7

Figure 4:
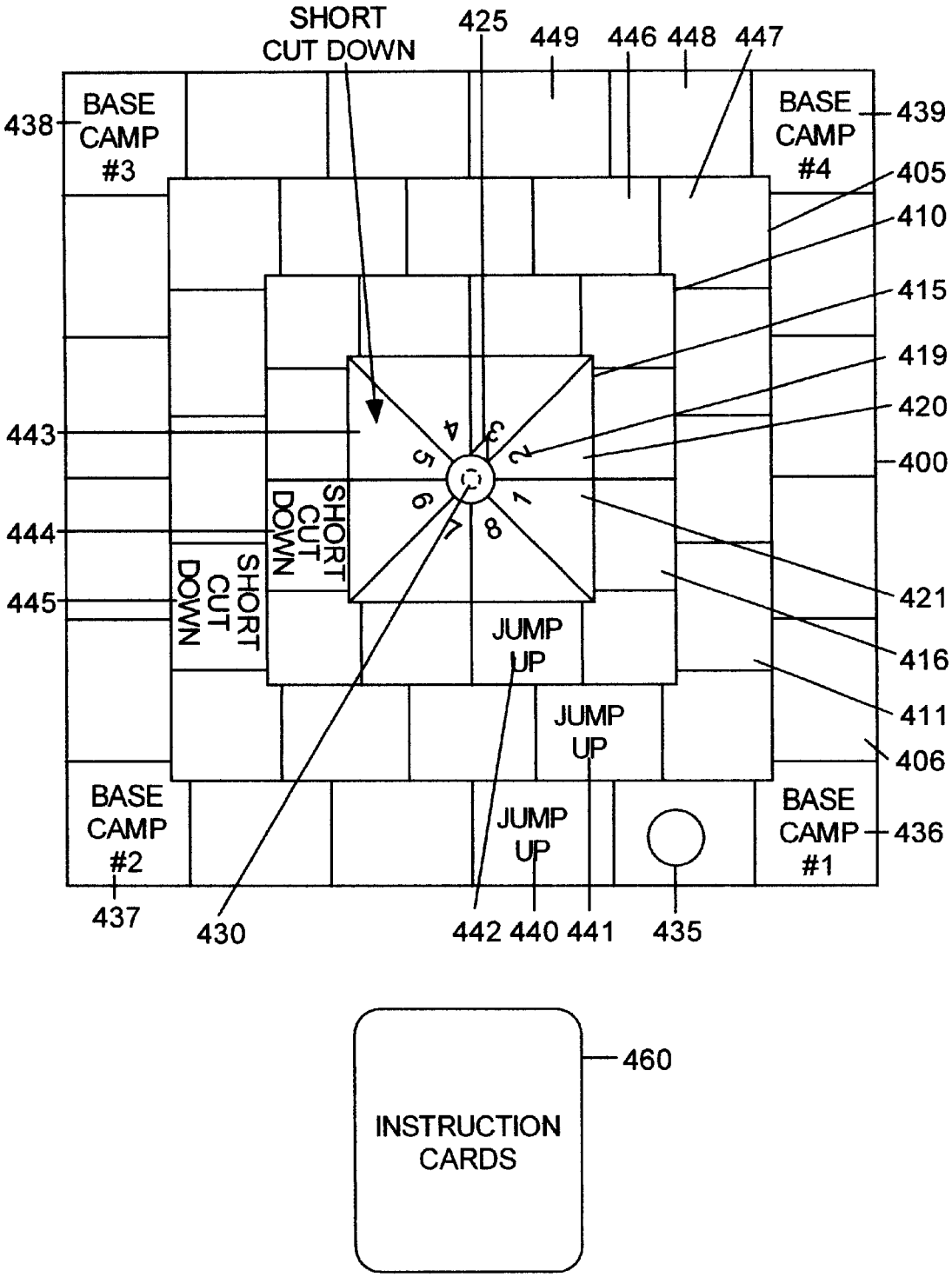
FIG. 4 is a top view of a multi-tier game according to the present invention.
Figure 5:
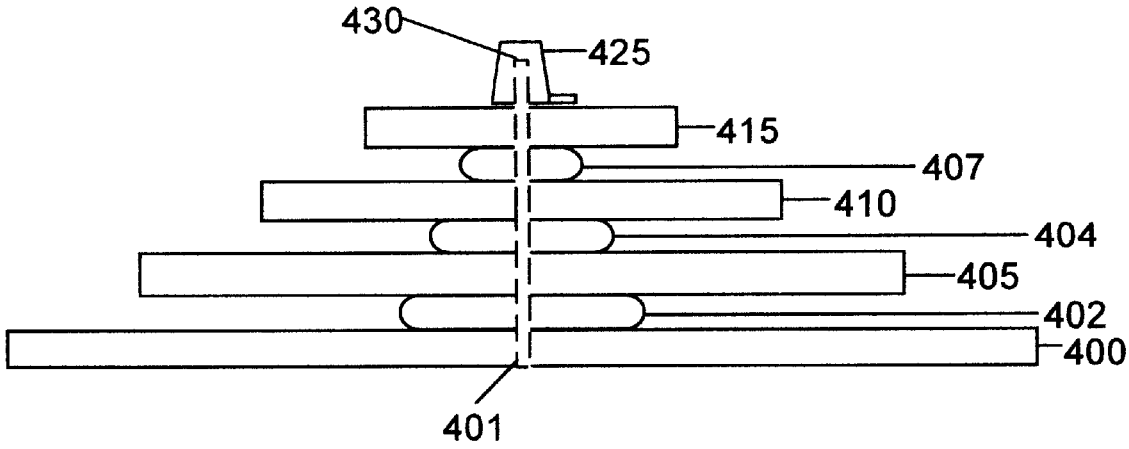
FIG. 5 is a side view of the game in FIG. 4.

FIGS. 4 and 5 (not to scale) show an alternative game comprising a board 400 with more than one swiveling tier above it. Board 400 is preferably 50 cm square and 0.5 cm thick, although it can be any size or shape. First tier 405 is typically the same shape, but 5 cm smaller than board 400. Successive tiers are each 5 cm smaller in height and width. Each tier is about 0.3 cm thick.

Successive tiers are separated by rings 402, 404, and 407, each about 0.2 cm thick. The diameter of each ring is about one-half of the edge dimension of the tier above it. Tiers 405, 410, 415, rings 402, 404, 406, and pointer knob 425 share a common axis on shaft 430. Shaft 430 fits into hole 401 in board 400. They are all mounted and turn independently on shaft 430. Shaft 430 is preferably about 3.2 cm in length and 0.5 cm in diameter. Rings 402, 404, and 407 are low-friction spacers, e.g., of polytetrafluoroethylene, which provide bearing surfaces for tiers 405, 410, and 415, respectively. Pointer knob 425 fits loosely over and is free to spin atop shaft 430. Knob 425 is pivoted to turn freely when it is spun. Tiers 405, 410, and 415 remain stationary until deliberately turned by a player.

Figure 6:
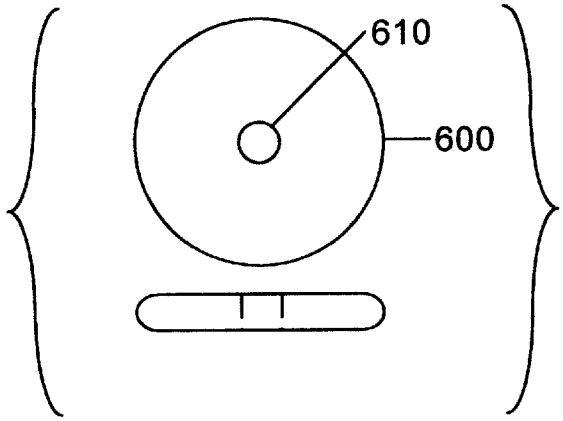
FIG. 6 shows top and side views of a spacer used with rotating tiers.

Rings 402, 404, and 407 are of successively smaller diameters. Each one supports the tier above, while not obscuring additional, normally hidden game fields (discussed in connection with FIG. 8 below). A generic ring 600 is shown in FIG. 6. Hole 610 is preferably 0.6 cm in diameter.

Board 400 and tiers 405, 410, and 415 each contain numerous game fields 406, 411, 416, and 421, respectively. In addition, top tier 415 contains numerals 420. Pointer 425 always points to one numeral on top tier 415. Each player is represented by a respective token 435 which is moved among game fields 406, 411, 416, and 421 according to the rules of each game.

Twenty four instruction cards 460 are included. Cards 460 are drawn when a hidden game field instructions say, "Take a Card", for example.

Operation—FIGS. 4 through 8

A typical game involves a treasure hunt. The object of this game is for a player to reach top tier 415 first, seize a "golden treasure", and then return via tiers 405, 410, and 415 back to board 400. Knob 425 is the golden treasure. When a player reaches top tier 415, they remove and hold the golden treasure. Knob 425 is then replaced by a different knob (not shown) in the shape of a skull and in the color of the player who has it so that other players can see who has the treasure. When a player lands on a game field 411 which says, "Rotate This Tier One-Quarter Turn Counterclockwise," he or she manually rotates tier 405 as instructed.

The players start by placing their respective tokens 435 at a base camp 426 a start location 436, 437, 438, or 439 on one of the four corners of board 400. Each player has a token 435 corresponding to the color of their Base Camp. For example, token 435 associated with Base Camp #1 is red, and so on. The first player spins pointer knob 425 and advances the number of game fields 406 on board 400, as indicated by numeral 419 on top tier 420. Skill and strategy are required, because a player can move in either direction.

The players encounter various instructional obstacles and beneficial instructions (not shown) when they land on particular game fields. On game fields 421, an instruction on that space may say "Cave in—fall down two levels" (instruction not shown). Or a beneficial instruction on space 446 would be "Find Treasure Map, move 3 spaces" (instruction not shown). A player advances to the next tier by landing on a "Jump up" instruction 440, 441, or 442 on board 400, first tier 405, or second tier 410, respectively. Similarly, a player descends to the tier below by landing on a "Short cut down" instruction 443, 444, or 445 on third tier 415, second tier 410, or first tier 405, respectively. Game fields 448 and 449 on board 400 straddle game field 446 on tier 405, similarly for all other game fields. When moving down from one tier to the next or to board 400, the player always moves into the left-hand game field on the level below. For example, descending from game field 446 on tier 105 to board 400, the player moves into game field 449. Similarly, in moving up, the player always moves into the left-hand game field.

The players also encounter other players by landing on the same game field. An opposing player who lands on the same game field can steal the treasure from the first player to land there. Certain game fields contain instructions which either help or hinder all players simultaneously. Through successive moves, the winner must return to the starting point, for example Base Camp #1 in square 436, which matches the color of their token, with the treasure.

Figure 7:
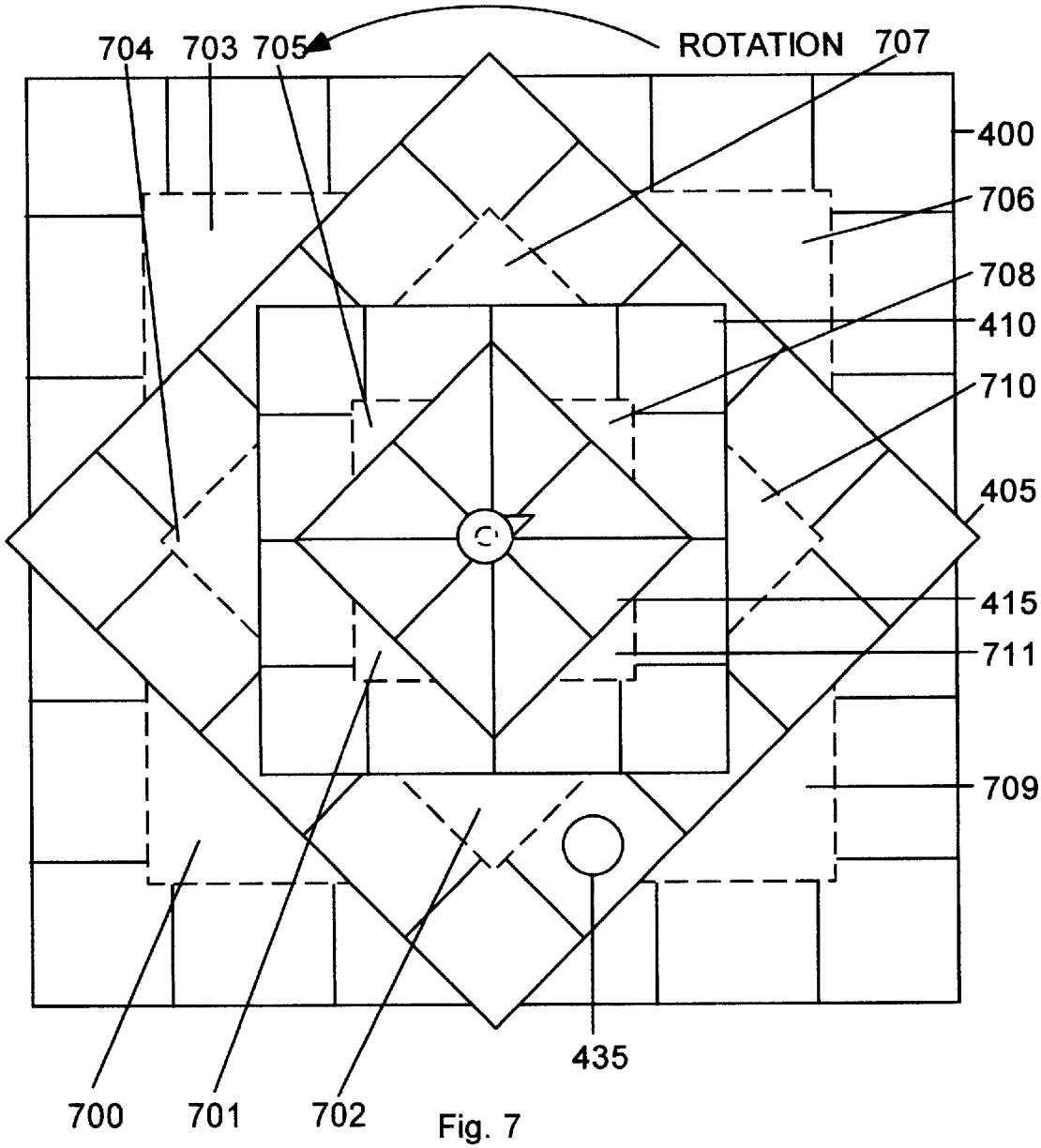
FIG. 7 shows tiers of the game of FIG. 4, rotated to reveal hidden game fields.

Additional game fields 700, 701, 702 are located beneath tiers 405, 410, and 415, respectively, as shown in FIG. 7. Normally hidden game fields 700 through 709 complement normally visible fields 406 et al. and each contains a unique instruction which is seen only occasionally during the progress of a game. Fields 700 through 709 become visible only when a tier is rotated one-eighth turn from its normally aligned position.

These hidden instructions add surprises to the play. For example, one hidden instruction can send a player empty-handed back to his Base Camp when the player is near the treasure at the top. Since they are normally out of sight, they are easily forgotten by unmotivated players. This can be an advantage to those players who give the game their full attention. These normally hidden instructions can be beneficial or harmful to a single player. A tier is turned one-eighth turn when a player lands on a game field on that tier, which says "Turn This Tier One-Eighth Turn to Reveal A Hidden Instruction." Although four instructions become visible, the player acts only on the one nearest his or her own token 435. For example, when tier 405 is rotated 45 degrees in either direction, triangular areas 700, 703, 706, and 709 on board 400 become visible, yet only the instruction in field 709 applies since field 709 is nearest the position of token 435.

After the hidden instructions are read and complied with, tier 405 is rotated back into alignment with board 400. A hidden instruction may say, "Take a Card." A card can instruct a player to "Capture the Treasure from another player within two turns." Or, to "Lose a Turn." After the hidden instructions are read, tier 405 is rotated clockwise or one quarter turn, thus hiding the instructions again. This action either returns tier 405 to its original position with respect to board 400, or advances tier 405 a total of one-quarter turn, thus aligning a new set of game fields on tier 405 with those on board 400. This action can physically affect all players' positions, changing the course of the game.

Figure 8:
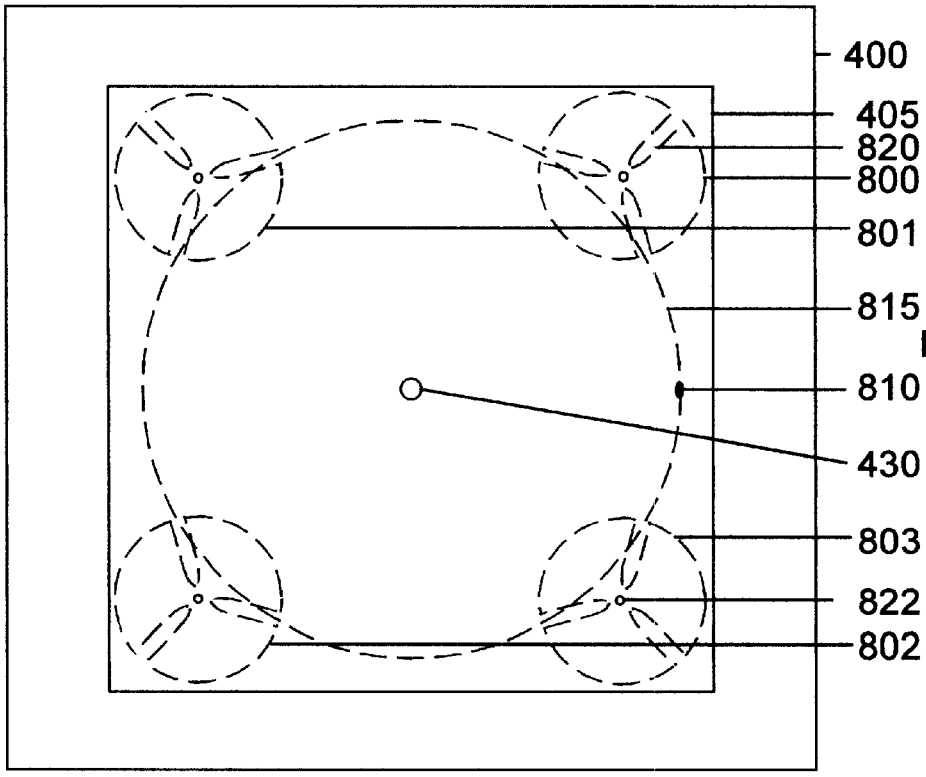
FIG. 8 shows rotating disks hidden beneath the first tier.
Figure 9:
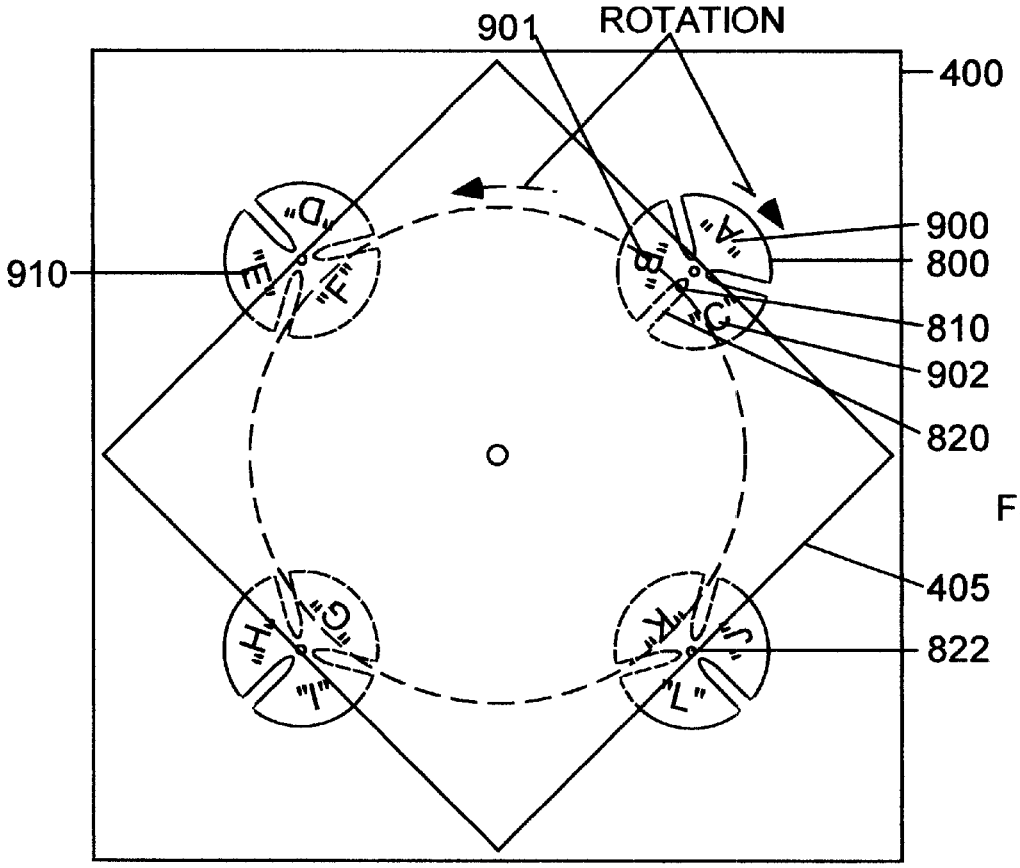
FIG. 9 shows rotating disks in view as the first tier is rotated 45 degrees.

Description—Second Alternative Embodiment—FIGS. 8 and 9

In the embodiment of FIGS. 8 and 9, game fields 900 are contained on disks 800 through 803 beneath square tier 405. Disks 800 through 803 are mounted on shafts 822 and rotate under the action of cog 810 (described below) as tier 405 rotates, providing additional, normally hidden, instructions for the players.

Hidden instructions are contained on wheels or disks 800 through 803. Disk 800 contains instructions 900 represented by "A", 901 represented by "B", and 902 represented by "C". Disk 801 contains instructions "C", "D", and "E", and so forth These instructions have been abbreviated here for clarity. Instructions "A" through "L" are similar to those described above in connection with FIG. 7. Instruction "A" reads "All Players Forfeit $100", for example. Instead of four hidden instructions for each tier as described above in connection with FIG. 7, this embodiment contains twelve hidden instructions, three for each of disks 800 through 803.

Tier 405 contains a cog 810 which follows path 815 as tier 405 is turned. Cog 810 projects from the underside of tier 405 and meets and enters slots 820 in disks 800 through 803, turning them. Each disk rotates one-third turn as the cog passes on their axes 822. Cog 810 is preferably 0.5 cm long and 0.2 cm in diameter. The cross-section of cog 810 is slightly elliptical in order to provide a smooth interaction with disks 800 through 803.

Operation—Second Alternative Embodiment—FIG. 9

When tier 405 is aligned with board 400, disks 800 through 803 are not visible. When a player's token (not shown) lands on a game field (not shown) on board 400 or tier 405 which says "Turn The Tier One-Eighth Turn Counterclockwise" and the player complies, instruction "A" becomes visible and must be acted upon. When tier 405 is rotated 45 degrees in either direction on shaft 430, all four disks 800 through 803 are visible, but only one is oriented for easy reading. This is the one which has been turned 60 degrees by cog 810. The other disks remain positioned so that only parts of two instructions are visible, for example instructions "D" and "E" on disk 910 are both only partially visible, and hence indeterminate. These instructions are ignored. On the other hand, instruction "A" on disk 800 is easily read. Thus this is the instruction in effect. Hidden instruction "A" contains a further instruction to realign tier 405 with board 400 by turning tier 405 either clockwise or counterclockwise. Thus after acting on hidden instruction "A", the player realigns tier 405 with board 400.

As tier 405 is rotated further, cog 810 moves to the top of board 400, as shown in FIG. 9. Cog 810 leaves each disk in an orientation which favors interaction between one of slots 820 and cog 810 as the rotation of tier 405 continues. Thus tier 405 can be rotated any number of times in either direction and each of disks 800 through 803 will be rotated 120 degrees, ready to expose the next instruction. When tier 405 is rotated 45 degrees with respect to board 400, cog 810 fully engages one of slots 820, rendering the instruction opposite that slot visible and active.

Conclusions, Ramifications, and Scope

It is thus seen that we have provided a board game with many new and heretofore unseen aspects. Our game provides excitement through its challenging, different methods of play. Excitement is increased because some instructions apply to all players at once. Furthermore, the randomness inherent in this game design causes the same player to be confronted with different choices and results at each point, even though the same moves are made up to that point. This game board mechanism offers multiple results and challenging play, while being simple to understand.

Moves are directed by spinning a pointer which ultimately rests on a game field containing a number. This number can indicate how many game fields a player is to move. The game field can also contain other instructions or information used in the game. Tiers can be multifunctional. In the case of square or rectangular tiers, instructions can be hidden beneath tiers. Hidden instructions add excitement by directing one or all players to make surprising and unexpected moves.

While the above description contains many specificities, these should not be considered limiting but merely exemplary. Many variations and ramifications are possible. For example, the game format is universal and can be applied to many game designs. In the case of board games, the same mechanical components with different printed surfaces can be used for widely different games, resulting in an economy of scale. For example, in addition to the Vacation Spin game shown and described, other games can be provided by imprinting different indicia (goals, instructions, etc.) on the board and tiers. For example, other games can be a space travel game called Galaxy Spin, an aviation game called Wright Spin, a stock market trading game called Wall Street Spin, and a story telling game called Spin A Tale. All games use the same board mechanisms as Vacation Spin. The game format is also applicable to computer games, console games, television game shows, hand-held computerized electronic games, and casino games.

The mechanical elements of our game can be made from a variety of materials such as paperboard, plastic, wood, pressed wood composite, and the like. The separators used in multi-tiered games can be made of plastic, felt, wood, metal, and the like. The pointer knob can be fancy and can be imprinted with a logo for the manufacturer or for a particular game.

Instead of a cog, the rotating disks under the first tier in FIG. 8 can be spun by the flick of a finger when they are exposed.

While the present system employs elements which are well known to those skilled in the art of game design, it combines these elements in a novel way which produces new results not heretofore discovered.

Accordingly the scope of this invention should be determined, not by the embodiments illustrated, but by the appended claims and their legal equivalents.

What is claimed is:

1. A storable board game apparatus comprising:

a foldable game board, said game board having an outer circle radially divided into a plurality of sectors to define a plurality of playing fields, one of said sectors including a pointer positioned thereon;

a circular tier having predetermined dimensions and positioned on top of said game board for rotation concentrically within said outer circle, said circular tier being radially divided into a plurality of tier sectors to define a plurality of second playing fields, said pointer included on said one of said sectors of said outer circle pointing to said second playing fields without touching thereof; and a swiveling mechanism having first and second substantially planar surfaces including means for causing said two surfaces to spin relative to each other, said swiveling mechanism sandwiched between said game board and said circular tier so that said first planar surface detachably attaches to said board and said second planar surface attaches to and supports said predetermined dimensions of said circular tier, whereby when said circular tier attached to said second planar surface is caused to spin, said second playing fields thereon will be randomly aligned opposite said pointer included on said one sector of said outer circle on said game board.

2. The board game apparatus of claim 1 wherein said first planar surface of said swiveling mechanism attaches to said board by force fitting said first planar surface into a hole dimensioned therefor in said board.

3. The board game apparatus of claim 1 wherein said second planar surface of said swiveling mechanism attaches to said circular tier by force fitting said second planar surface into a recess in said circular tier dimensioned therefor.

4. The board game apparatus of claim 1 in which said included means of said swiveling mechanism causing said first and second planar surfaces to spin relative to each other are ball bearings.

5. The board game apparatus of claim 1 further including a knob attached to the top of said circular tier in which to spin said swiveling mechanism.

6. The board game apparatus of claim 1 in which said pointer included on said one sector of said outer circle on said board is a C-shaped element having a lower part thereof detachably attached to said board and having an upper part thereof forming said pointer pointing to, but not touching said tier sectors of said circular tier.

7. A method of operating a storable board game comprising the steps of:

a) unfolding a foldable game board having an outer circle radially divided into a plurality of sectors to define a plurality of playing fields;

b) positioning a circular tier having predetermined dimensions on top of said game board for rotation concentrically within said outer circle, said circular tier radially divided into a plurality of tier sectors to define a plurality of second playing fields;

c) including a pointer on one of said sectors of said outer circle for pointing to said tier sectors without touching thereof;

d) sandwiching a swiveling mechanism between said game board and said circular tier, said swiveling mechanism having first and second substantially planar surfaces including means for causing said two surfaces to spin relative to each other, said swiveling mechanism dimensioned so as to support said predetermined dimensions of said circular tier;

e) attaching said first planar surface of said swiveling mechanism to said board and attaching said second planar surface of said swiveling mechanism to support said predetermined dimensions of said circular tier; and f) spinning said circular tier attached to said second planar surface so that said plurality of second playing fields thereon will be randomly aligned opposite said pointer included on said one sector of said outer circle of said game board.

8. A board game apparatus comprising:

a game board having a predetermined polygonal shape with corners in which a perimeter thereof is divided into a plurality of playing fields arrayed around said perimeter of said board, said game board having a central shaft attached thereto;

a plurality of at least three stacked tiers having said predetermined polygonal shape but in which each successive tier is dimensioned smaller than the tier below, said plurality of tiers positioned in concentric fashion about said central shaft, each of said stacked tiers except for the top tier also having a plurality of playing fields arrayed about a perimeter of each respective tier, said top tier having a plurality of movement information spaced about its perimeter;

spacer means included between each of said stacked tiers for permitting frictional movement of said plurality of tiers about said central shaft relative to and independent of each other, said game board and said stacked tiers all having predetermined dimensions so that upon movement of any one of said stacked polygonal tiers about said shaft causes said corners of said one tier to cover or hide certain playing fields of said arrayed playing fields immediately therebelow; and a detachable, spinable knob with a pointer positioned loosely atop said shaft so that upon being spun, movement information on said top tier is randomly pointed to thereon.

9. The board game of claim 8 in which the number of said stacked tiers is four.

10. The board game of claim 8 in which said predetermined polygonal shape with corners of said board and said stacked tiers is a square.

11. The board game of claim 8 wherein said detachable, spinable knob doubles as a game piece and is replaceable with other knobs.

12. The board game of claim 8 wherein said movement information on said top tier is a set of numbers.

13. The board game of claim 8 further including at least one rotatable disk rotating about a shaft on said game board off-center to said central shaft and in which said disk is hidden by said corners of a bottom tier of said at least three stacked tiers, said disk including radial slots extending from the perimeter of said disk towards said off-center shaft with information for playing said board game appearing between each set of two radials so that upon rotation of said bottom tier a predetermined amount, said information between one set of radials only on said disk is exposed.

14. The board game of claim 13 wherein said bottom tier further includes a cog protruding below said bottom tier and positioned so that as said bottom tier is rotated about said central shaft, said cog will engage one of said radial slots on said disk so as to rotate said disk to a new position to exposed new information for playing said board game.

* * * * *